US006238308B1

(12) United States Patent
Sanchez

(10) Patent No.: US 6,238,308 B1
(45) Date of Patent: May 29, 2001

(54) BAT BAG

(76) Inventor: Osvaldo Sanchez, 9708 Elm Way, Tampa, FL (US) 33635

( * ) Notice: Subject to any disclaimer, the term of this patent is extended or adjusted under 35 U.S.C. 154(b) by 0 days.

(21) Appl. No.: 09/429,709

(22) Filed: Oct. 29, 1999

(51) Int. Cl.[7] ..... A63B 69/00

(52) U.S. Cl. ..... 473/451; 473/422; 472/103; 482/123

(58) Field of Search ..... 473/420–423, 473/417–418, 427–429, 451–453, 457, 461, 594, 440–445; 482/83, 25, 142, 72, 123, 130; 248/371, 176.1, 629; 24/85.7; D21/689–691, 674, 673, 675–678; 472/95–105; 297/196, 197

(56) References Cited

U.S. PATENT DOCUMENTS

| | | | | |
|---|---|---|---|---|
| D. 294,843 | | 3/1988 | Lund . | |
| 1,998,508 | * | 4/1935 | Kappenberg | 472/103 |
| 2,934,343 | * | 5/1960 | Schumacher | 473/445 |
| 3,336,805 | * | 8/1967 | Austin | 473/442 |
| 3,927,879 | * | 12/1975 | Long et al. | 482/83 |
| 4,079,929 | * | 3/1978 | Varnum | 472/99 |
| 4,123,053 | | 10/1978 | Piccini . | |
| 4,239,209 | * | 12/1980 | Curchod | 482/83 |
| 4,681,332 | * | 7/1987 | Malone | 297/5 |
| 5,087,039 | | 2/1992 | Laseke . | |
| 5,112,287 | * | 5/1992 | Brewer | 482/123 |
| 5,226,645 | | 7/1993 | Stewart . | |
| 5,303,914 | | 4/1994 | Cooksey . | |
| 5,503,391 | | 4/1996 | Stelly . | |

* cited by examiner

*Primary Examiner*—Jeanette Chapman
*Assistant Examiner*—Mitra Aryanpour
(74) *Attorney, Agent, or Firm*—Patent & Trademark Services; Joseph H. McGlynn

(57) ABSTRACT

A hitting trainer which has a slanted surface mounted on a stand, and which the player will hit with a bat in order to develop strength and quickness.

3 Claims, 1 Drawing Sheet

BAT BAG

BACKGROUND OF THE INVENTION

This invention relates, in general, to training equipment, and, in particular, to training equipment for training a batter for hitting

DESCRIPTION OF THE PRIOR ART

In the prior art various types of training equipment have been proposed. For example, U.S. Pat. No. Des. 294,843 to Lund discloses a novelty device having a baseball on a spring.

U.S. Pat. No. 4,123,053 to Piccini discloses a training device which has a cylinder filled with elastomeric material suspended from a support.

U.S. Pat. No. 5,087,039 to Laseke discloses a training apparatus having a stand which holds a supply of baseballs which are delivered, one at a time, to a support that holds a ball while a player practices hitting.

U.S. Pat. No. 5,226,645 to Stewart discloses a hitting trainer which has a pair of tubular devices spaced apart enough for a bat to pass through so a hitter can practice his swing.

U.S. Pat. No. 5,303,914 to Cooksey discloses a hitting trainer which has a stand upon which are placed a plurality of baseballs spaced at different heights.

U.S. Pat. No. 5,503,391 to Stelly discloses a hitting trainer which has a tire mounted on a stand which a hitter can hit with a bat.

SUMMARY OF THE INVENTION

The present invention is directed to a hitting trainer which has a slanted surface mounted on a stand, and which the player will hit with a bat in order to develop strength and quickness.

It is an object of the present invention to provide a new and improved hitting trainer.

It is an object of the present invention to provide a new and improved hitting trainer which will develop strength in a hitter.

It is an object of the present invention to provide a new and improved hitting trainer which is inexpensive to make and easy to transport.

These and other objects and advantages of the present invention will be fully apparent from the following description, when taken in connection with the annexed drawings.

DESCRIPTION OF THE PREFERRED EMBODIMENT

Figure 1:
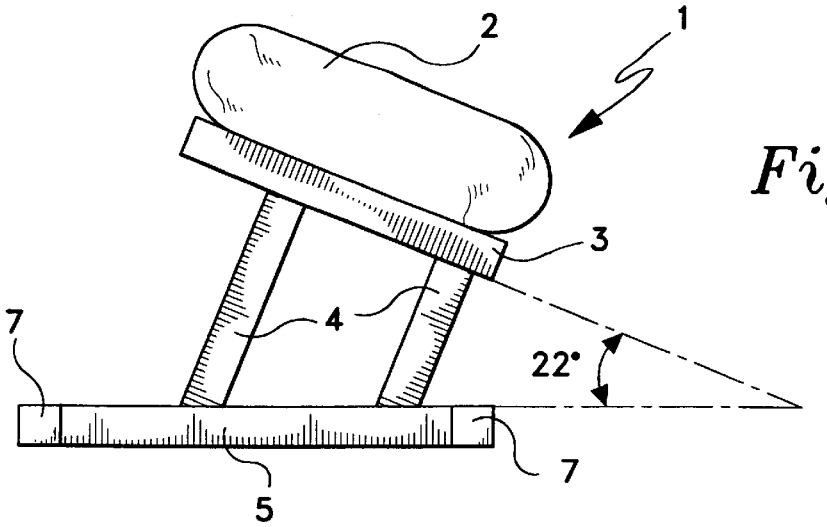
FIG. 1 is a side view of the present invention.
Figure 2:
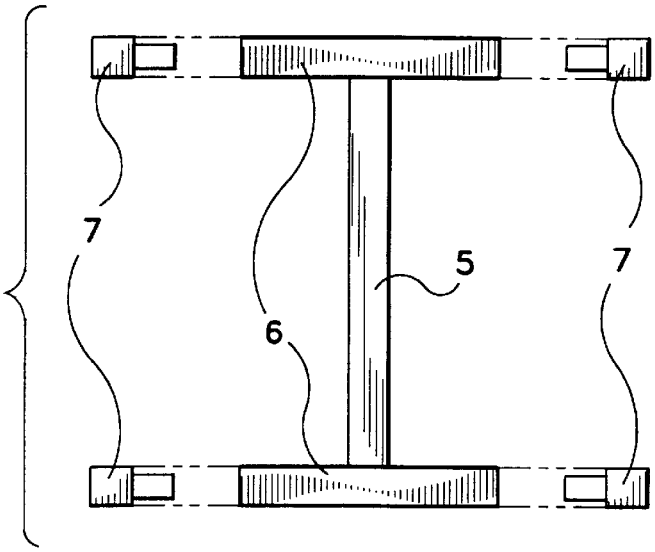
FIG. 2 is a top view of the present invention.
Figure 3:
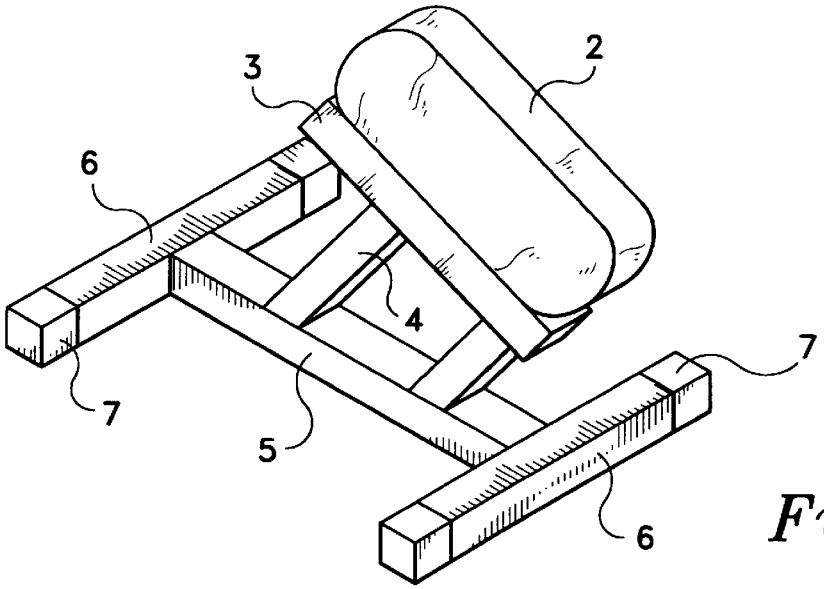
FIG. 3 is a perspective view of the present invention.

Referring now to the drawings in greater detail, FIG. 1 shows the training device 1 of the present invention. The device has a stand preferably constructed of 2 inch steel tubing welded together, however, it should be understood that other materials or methods of joining the materials could be used without departing from the scope of the invention. The stand comprises a pair of horizontal support members 6 which are joined by a cross member 5. Attached to the horizontal support members 6 are at least a pair of vertical support members 4. Each of the horizontal support members 6 have end caps 7 attached to the opposite ends of the members, as shown in FIG. 2.

The vertical members 4 are preferably bolted to the cross member 5 so the training device can be at least partially disassembled for transportation and storage. Attached to the vertical support members 4 is a support bar 3, and attached to the support bar 3 is a bag 2 made from durable foam which can be covered with a material such as Vinyl. The bag can be attached to the horizontal support bar 3 in any conventional manner. The horizontal support members6 and the cross member 5 form a base to support the bag 2.

As shown in FIG. 1 the bag 2 is attached to the stand at an angle of approximately 22° with the cross member 5. This can be accomplished by making one of the vertical supports 4 shorter than the other vertical support. This angle is critical because it will train a batter to hit down on the ball which is important in developing a proper swing.

By striking the bag 2 with a bat, a player will develop strength and quickness. In essence the player will use the present invention in a similar manner to a boxer using a punching bag or a football player using a blocking sled.

In use, a player will stand along side the training device with a bat in his/her hands and assume a batting stance just as if they were going to hit a baseball. Then the player will strike the bag 2 with the head of the bat, as if the bag were a ball. The player will repeat this exercise, thereby building up his/her strength and quickness. In addition, when the player hits the bag, he/she can stop his/her swing and observe the position of the body, hands and bat at the time of impact. This will enable the player to correct any imperfections in the swing.

Although the Bat Bag and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A hitting training device comprising:

a base, at least a pair of vertical members attached to said base, one of said at least a pair of vertical members being shorter than another of said at least a pair of vertical members, a first support member connected to said at least a pair of vertical members, said first support member having a first end and a second end, said at least a pair of vertical members being connected to said first support member intermediate said first and second ends of said first support member, a second support member, a third support member, said second support member being secured to said first support member at said first end of said first support member, and said third support member being secured to said first support member at said second end of said first support member, a bag attached to said base.

2. The hitting training device as claimed in claim 1, wherein said second and third support members have caps attached to opposite ends of said second and third support members.

3. The hitting training device as claimed in claim 1, wherein said bag is made from durable foam.

* * * * *